US005097178A

United States Patent [19]

Nishihara

[11] Patent Number: 5,097,178

[45] Date of Patent: Mar. 17, 1992

[54] RF ELECTRON GUN WITH CATHODE ACTIVATING DEVICE

[75] Inventor: Susumu Nishihara, Hyogo, Japan

[73] Assignee: Mitsubishi Denki Kabushiki Kaisha, Tokyo, Japan

[21] Appl. No.: 655,882

[22] Filed: Feb. 14, 1991

[30] Foreign Application Priority Data

Aug. 4, 1990 [JP] Japan ..... 2-207302

[51] Int. Cl.[5] ..... H01J 7/24; H01J 19/14; H01J 9/50; H05B 31/26

[52] U.S. Cl. ..... 315/111.81; 313/337; 313/346 R; 313/310; 313/446; 445/2; 445/6

[58] Field of Search ..... 315/5.41, 5.39, 111.81, 315/94; 328/227; 313/326, 325, 337, 346 R, 310, 446; 445/2, 6, 61

[56] References Cited

U.S. PATENT DOCUMENTS

| | | | |
|---|---|---|---|
| 2,284,751 | 6/1942 | Linder | 315/5.41 |
| 3,745,342 | 7/1973 | LePoole | 313/337 |
| 4,115,720 | 9/1978 | Levine | 313/337 |
| 4,641,103 | 2/1987 | Madey et al. | 315/5.29 |
| 4,978,893 | 12/1990 | Brannon et al. | 315/111.81 |

*Primary Examiner*—Eugene R. LaRoche
*Assistant Examiner*—Michael B. Shingleton
*Attorney, Agent, or Firm*—Rothwell, Figg, Ernst & Kurz

[57] ABSTRACT

A RF electron gun, such as for use in a linear electron accelerator, having a cathode activating device which, in one embodiment, includes means for altering the phase of the accelerating electric field to accelerate emitted electrons in the reverse direction to cause them to strike the cathode, thereby activating the cathode. In another embodiment, laser light is directed onto the cathode for activation thereof and, in a further embodiment, the electric field is positioned and directed at the cathode to cause the activation thereof.

3 Claims, 4 Drawing Sheets

RF ELECTRON GUN WITH CATHODE ACTIVATING DEVICE

BACKGROUND OF THE INVENTION

1. Field of the Invention

This invention relates to a RF electron gun which is used for a linear electron accelerator and provided with a cathode activating device.

2. Description of the Prior Art

FIG. 1 is a sectional view showing a conventional electron gun described in, for example, "Nuclear Instruments and Methods in Physics Research" 222–226 pages, A272, 1988, North-Holland Physics Publishing Division. In FIG. 1, reference numeral 1 designates a RF electron gun, 2 a cathode which is provided at the center portion of the RF electron gun to generate electrons, 3 a filament for heating the cathode from the rear of the cathode, 4 a power source for the filament, 5 a baking control device which controls the power source for baking, 6 a RF cavity in which a field for accelerating electrons is formed, 7 a waveguide connected to the RF cavity, and 8 a microwave generating device connected to the waveguide.

Next, the operation of the RF cavity will be described. Before usage of the RF electron gun 1, the cathode 2 is heated for a long time while it is temperature-controlled by the filament 3, thereby performing baking. By this, gases such as impurities contained in the cathode 2 in manufacturing are removed by a vacuum pump not shown to suppress subsequent generation of ionized gases when the cathode 2 is heated in usage thereof. This allows the degree of vacuum in operation to be raised, by which it becomes easy to generate electrons from the cathode 2. In the above-mentioned literature, the degree of vacuum of 1 to $10^{-10}$ Torr is obtained by baking for several tens of hours at about 200° C. This baking is used for lessening the reduction in thermionic electron radiation caused by formation oxides on the surface of the cathode depending on materials of the cathode 2 by residual gases. In practical usage, after baking, the cathode 2 is heated by the filament 3 to cause generation of electrons from the cathode 2. The electrons are subjected to an accelerating electric field of microwaves via the waveguide 7 from the microwave generating device 8 to cause acceleration. The principle of the acceleration will be described in detail in the embodiments of this invention presented herein.

Since the conventional RF electron gun has the above-mentioned structure, in order to control the temperature of the gun for a long time so that the temperature is maintained at a predetermined temperature for activating the cathode, there are problems that the apparatus for controlling and maintaining the predetermined temperature for a long time period is complicated and, difficult to operate, and requires a long time for the operation thereof.

SUMMARY OF THE INVENTION

This invention has been accomplished in an attempt to solve the above-mentioned problems of the prior art, and it is a first object of this invention to obtain a RF electron gun capable of activating a cathode within a short time.

It is a second object of this invention to obtain a RF electron gun capable of being operated simply.

It is a third object of this invention to obtain a RF electron gun having a great effect of activating a cathode using a simple device without using a complicated and expensive device.

In order to achieve the above-mentioned objects, a RF electron gun according to a first aspect of this invention includes phase control means for controlling the phase of the electric field generated in the microwave generating device, and means of operating the phase control means so that the phase of the above-mentioned RF electric field accelerates in the reverse direction electrons emitted once from the cathode, thereby causing the electrons to strike the cathode and activate the cathode.

A RF electron gun according to a second aspect of this invention provides a laser light generating device and irradiates laser light generated by the laser light generating device on the above-mentioned cathode in order to cause activation thereof.

A RF electron gun according to the third aspect of this invention discharges impurities from the surface of the above-mentioned cathode using the above-mentioned RF electric field. The term "discharge" is used herein (as applied to the cathode and its surface) to mean "empty" the cathode or surface of impurities in the form of residual gases and the like.

The above-mentioned and other objects and new features of this invention will become more apparent from the following detailed description taken with reference to the accompanying drawings. But, the drawings are for only explanation, and do not define the scope of this invention.

DETAILED DESCRIPTION OF THE PREFERRED EMBODIMENTS

Preferred embodiments according to this invention will now be described in detail referring to the accompanying drawings.

Figure 1:
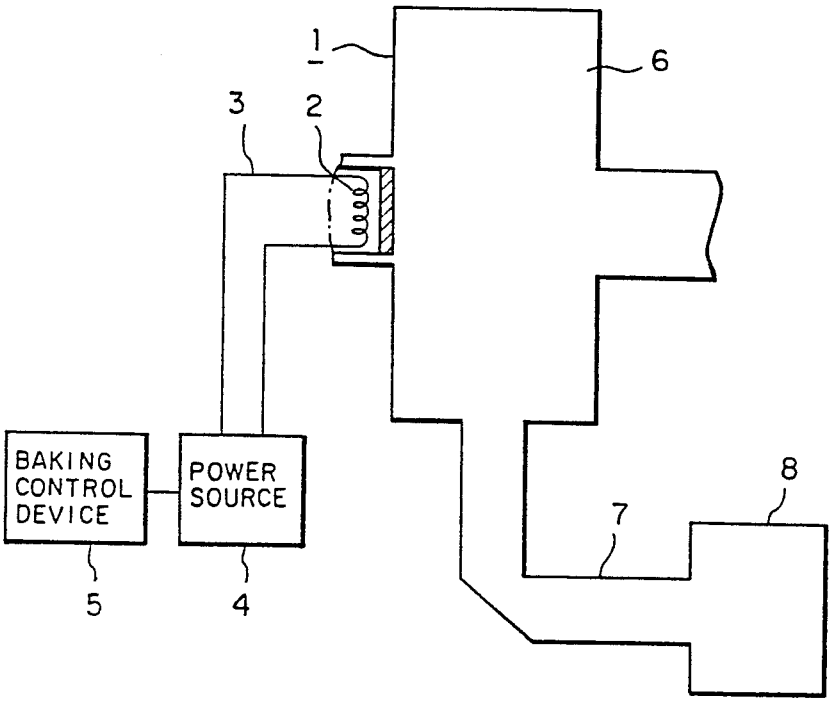
FIG. 1 (PRIOR ART)
FIG. 1 is a schematic diagram of a conventional RF electron gun.
Figure 2:
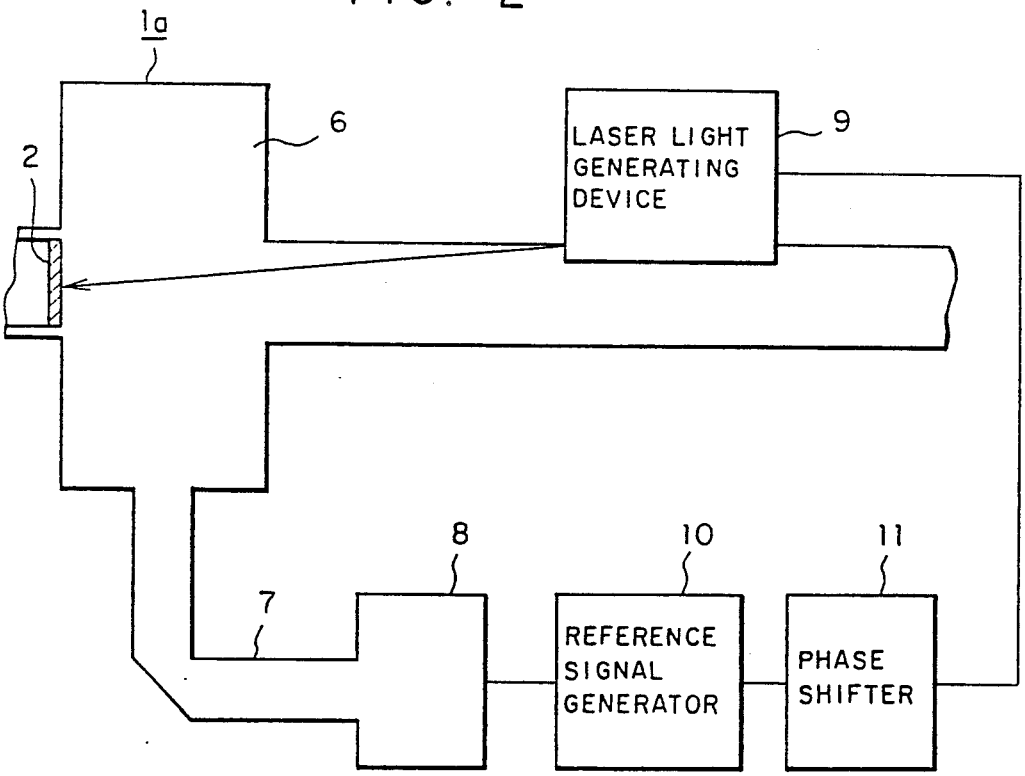
FIG. 2 is a schematic diagram of a RF electron gun according to a first embodiment of this invention.

In FIG. 2, reference numerals 2 and 6 to 8 are same as those in the prior art embodiment of FIG. 1 and their description will therefore be omitted herein to avoid unnecessary repetition. Reference numeral 1*a* designates a RF electron gun according to this invention, 9 a laser light generating device which generates laser light for exciting a cathode and generating photoelectrons, 10 a reference signal generator and reference signal generating means of the above-mentioned microwave generating device, and 11 a phase shifter and phase control means disposed between the above-mentioned microwave generating device and laser light generating device 9.

The RF electron gun 1*a* is subjected to microwaves from the generating device 8, which generates microwave responsive to a signal from the above-mentioned reference signal generator 10, which microwave are applied to the above-mentioned RF cavity 6 via waveguide 7. Laser light of several pico seconds mode-locked by the above-mentioned laser light generating device 9 is synchronized with the timing of the accelerating phase from the above-mentioned phase shifter 11. This laser light is made to strike the above-mentioned cathode to generate photoelectrons, which are accelerated by introducing them the RF cavity 6 during the accelerating phase of the microwave generated by the above-mentioned microwave generating device 8.

Figure 3:
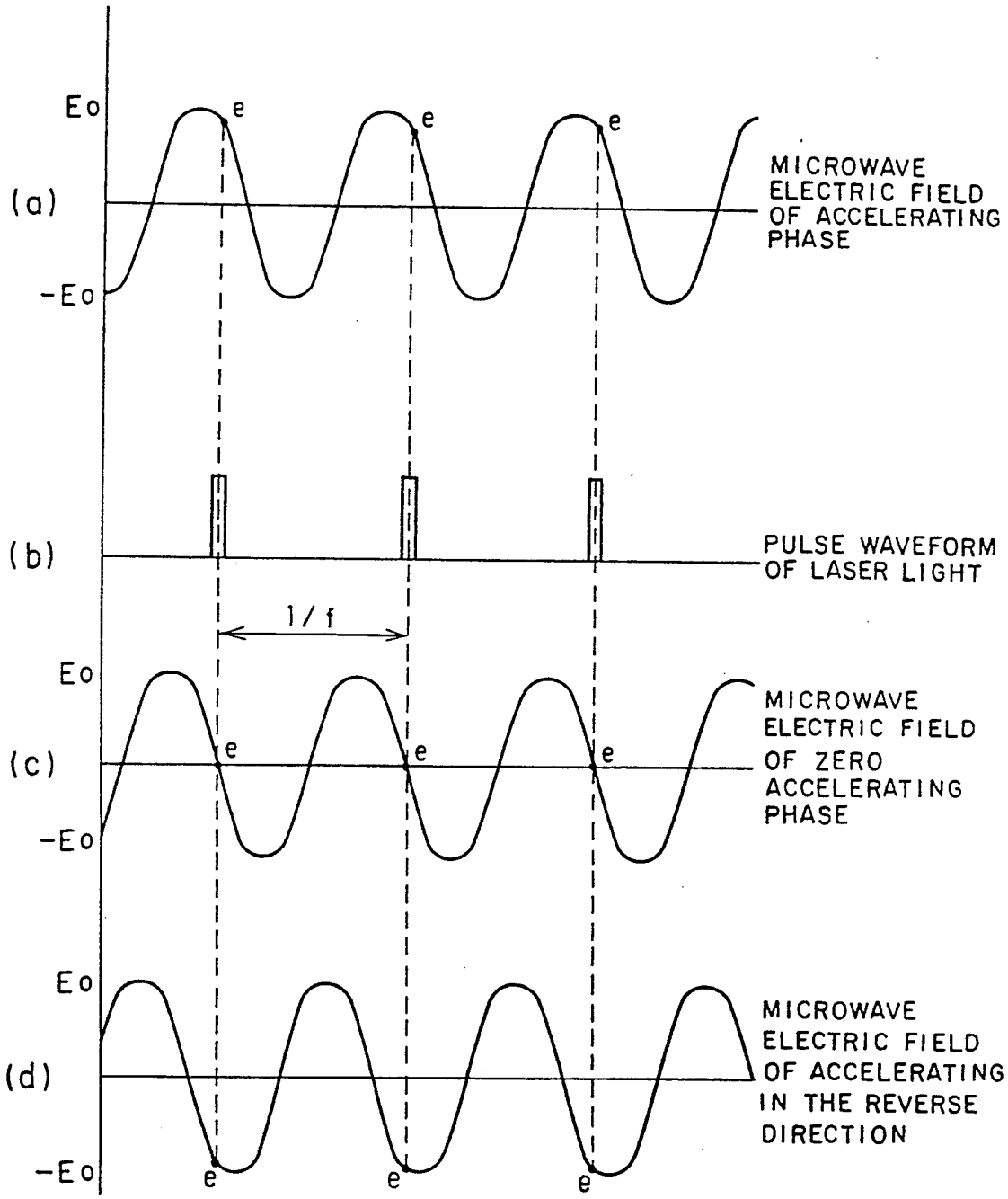
FIG. 3 is an explanatory diagram showing the relationship between the electrons and the microwave electric field.

The phase of the microwaves and the timing of generation of the laser light will be described with reference to FIG. 2 and FIG. 3. FIG. 3(*a*) represents a microwave electric field having an accelerating phase, FIG. 3(*b*) represents a pulse waveform of the laser light, FIG. 3(*c*) represents a microwave electric field having 0 accelerating phase FIG. 3(*d*) represents a microwave electric field having an accelerating phase in the reverse direction. In FIG. 3, an x-axis, a y-axis, e, and f represent a time axis, the intensity of the electric field, an electron, and an oscillating frequency of the above-mentioned reference signal generator 10, respectively. Accordingly, in FIG. 3(*b*) $\tau$ becomes the period of the pulse wave of the laser light and coincides also with the period of the microwave electric field. After the laser light is made to generate at the phase of the microwave electric field in an accelerating state shown in FIG. 3(*a*) by the above-mentioned laser light generating device 9 shown in FIG. 2 and made to strike the above-mentioned cathode to generate electrons, when the microwave electric field is made to advance gradually by the above-mentioned phase shifter 11, the microwave electric field becomes as shown in FIG. 3(*b*) to (*d*), by which the electron e is brought from an accelerating state into a zero accelerating state and then an accelerating state in the reverse direction by the microwave electric field.

Figure 4:
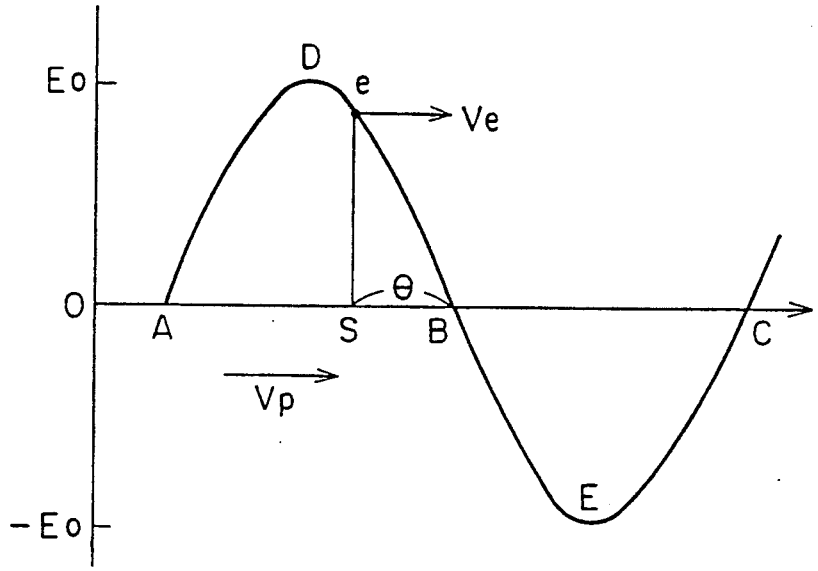
FIG. 4 is an explanatory diagram showing the relationship between the electrons and the microwave electric field at the time of acceleration.
Figure 5:
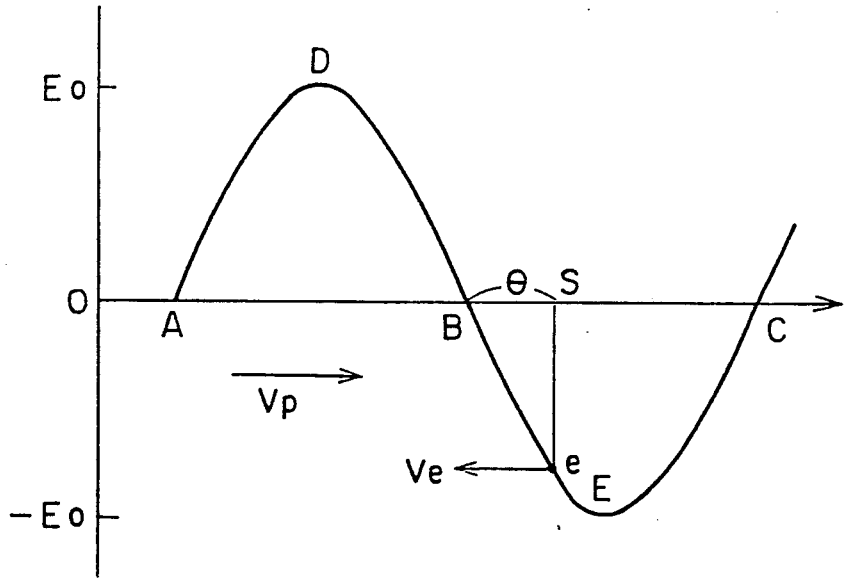
FIG. 5 is an explanatory diagram showing the relationship between the electrons and the microwave electric field at the time of deceleration.

This will be described in detail in FIG. 4 and FIG. 5. According to FIG. 4 and FIG. 5 recorded at pp 256–266 in the book entitled "Accelerator", Experimental Physics Lecture, Vol. 20, published by Kyoritsu Shuppan Co., Ltd., a linear electron accelerator is a RF type particle accelerating device which accelerates electrons straightly by a strong microwave electric field. Now, let us consider a portion of an electric wave which travels from left to right with a phase velocity Vp as shown in FIG. 4. A phase for accelerating electrons exists between A and B, and a phase for decelerating electrons exists between B and C. If the velocity of electrons Ve is largely different from the velocity Vp, the phase $\theta$ of the electrons for the electric wave deviates with time. Consequently, acceleration and deceleration are alternately repeated, and no acceleration and no deceleration take place on average. But, if the velocity of the electrons is equal to the phase velocity of the electric wave, and the phase of acceleration is put on, for example, a point S, the electron is always subjected to the function of the electric field $Ez = Eo \cdot \sin\theta$ if the peak value of the microwave electric field is represented by Eo. If the electron travels with the electric wave by the distance L, the electron obtains the following kinetic energy.

$$e \cdot L \cdot Eo \cdot \sin\theta$$

Since the electron is accelerated and its velocity is increased, the phase velocity of the electric wave has to be increased in accordance with the velocity of the electron. But, since an electron is light in mass, its velocity is quickly increases to close to the velocity of light. But, the velocity of light is the upper limit of the velocity of an electron owing to the principle of relativity, the phase velocity is adjusted to the velocity of the electron, and it may be constant ($\approx$C).

The acceleration in the reverse direction for the electron will be described using FIG. 5. When the cathode 2 is activated, the electron generated from the cathode 2 is extracted by a positive electric field and accelerated. The electron is brought into a negative electric field with change in time, decelerated in velocity thereof, and stopped. Finally, the electron is accelerated in the reverse direction, and always subjected to the function of the electric field $Ez \cdot Eo \sin\theta$ if it is put on, for example, the point S. Consequently, the electron is accelerated and increased in velocity thereof. If the electron travels with the electric wave by the distance L, it obtains the kinetic energy described below.

$$e \cdot (-L) \cdot (-Eo) \cdot \sin\theta$$

The electron which has obtained the kinetic energy strikes atoms of the cathode 2, thereby activating the cathode 2. Incidentally, the electron is accelerated so as to obtain suitable energy for activating the cathode 2 depending on the kind of materials of the cathode 2.

Figure 6:
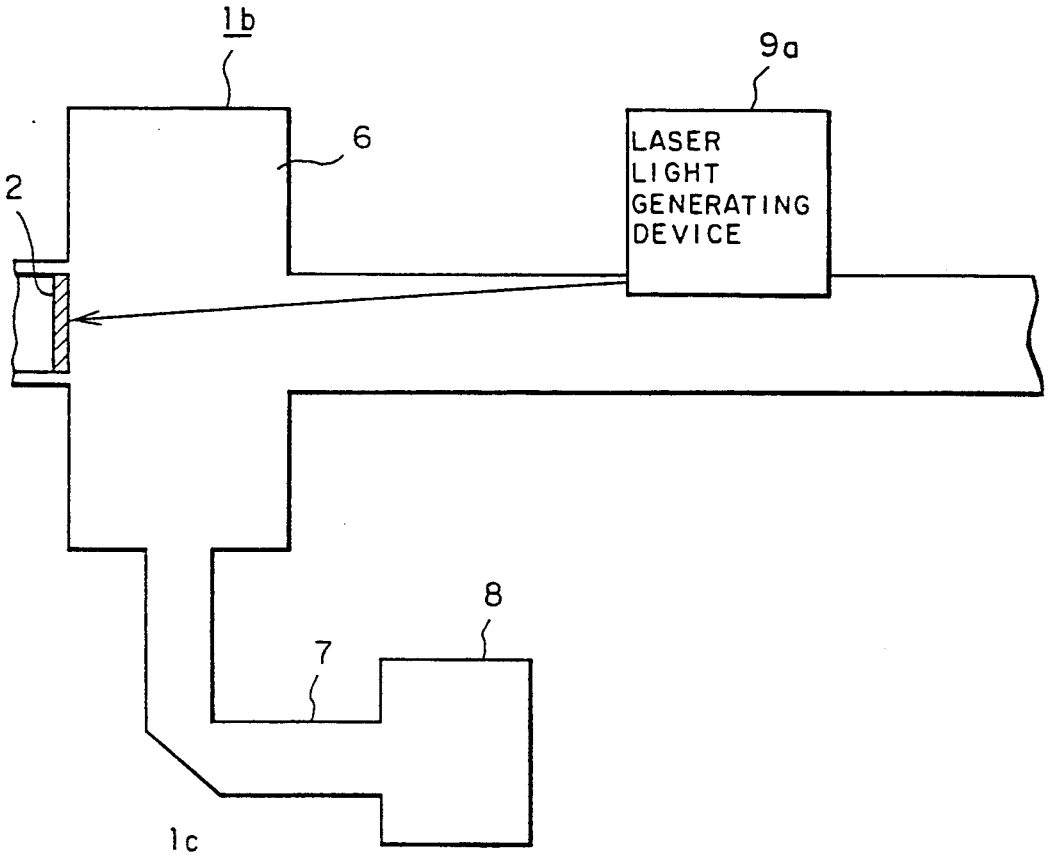
FIG. 6 is a schematic diagram of a RF electron gun according to a second embodiment of this invention.

Next, a RF electron gun according to the second embodiment of this invention will be described in reference to FIG. 6. In FIG. 6, reference numeral 1*b* designates a RF electron gun, 6 to 8 are same as those in the conventional embodiment, 9*a* designates a laser light generating device for activating the cathode 2.

The laser light generating device 9*a* has a spectrum provided with a large work function and a high activation effect. For instance, the laser light generating device 9*a* irradiates pulsive excimer laser light on the cathode 2. In this time, if the excimer laser light is continuous light, the output of the laser light generating device 9*a* is great, and if the output thereof is too sufficient, the whole of the cathode 2 is fuzed. Atoms of the cathode 2 become plasmatic on the surface of the cathode 2 irradiated by the excimer laser light, and impurities, oxide film, and the like are removed, thereby activating the cathode. If the light intensity of the excimer laser light and the duty ratio of the pulse thereof are adjusted so as to usually make only the surface of the cathode 2 be in an optimum temperature for making plasmatic, the cathode 2 can be efficiently activated. Incidentally, if the intensity of the laser light is strengthened and the duty ratio of the pulse thereof is increased, in short, if the average power is made constant and the time of period of irradiation is made short, only the surface of the cathode 2 can be made plasmatic so much. On the contrary, if the time of period of irradiation is made long, the effect of smoothing the surface of the cathode 2 is obtained because the time of period during which heat diffuses over the whole of the cathode 2 is given.

Figure 7:
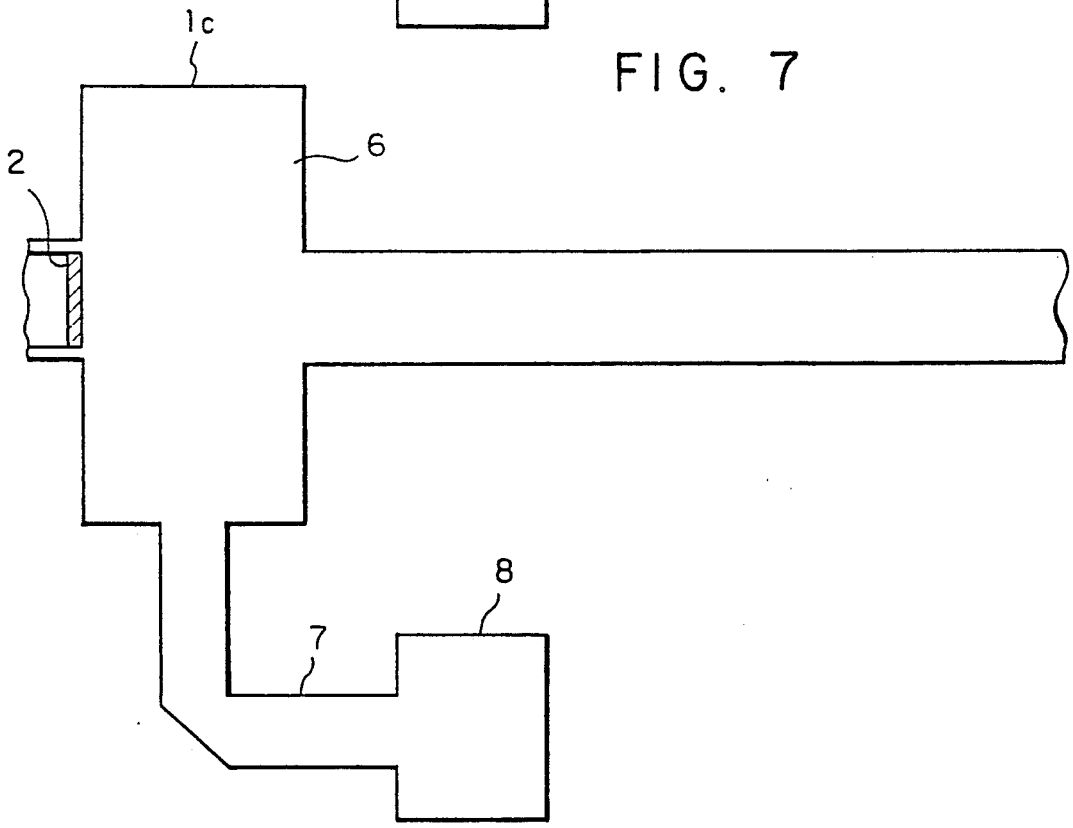
FIG. 7 is a schematic diagram of a RF electron gun according to a third embodiment of this invention.

Next, a RF electron gun according to the third embodiment of this invention will be described in reference to FIG. 7. In FIG. 7, reference numeral 1*c* designates a RF electron gun and 6 to 8 are same as those in the conventional embodiment.

In the present embodiment, the surface of the cathode is discharged of impurities by a RF electric field generated in the RF cavity 6 by the microwave generating device 8 to activate the cathode 2. In a state in which the surface of the cathode has not been activated, impurity gases and the like are absorbed in the surface of the cathode, the degree of vacuum is not increased, and electrons are difficult to generate. In such a state, when the electrons are made to collide with an anode by a RF electric field generated in a RF cavity, positive ions and photons are generated by ionization of anode substance (gas and extraneous matters) and the like and the positive ions and the photons collide with the cathode, thereby emitting secondary electrons. By such a process, the surface of the cathode is discharged, and gas molecules which have been absorbed in the surface are picked out, thereby allowing the above-mentioned cathode to be activated. Also, according to the "Discharge Handbook", pp 233–236, edited by the Institute of Electric Engineers of Japan, published by OHM Co., Ltd., the phenomena which features the RF discharge generated by the microwave are the motions of the positive ions and the electrons owing to an alternating electric field. Assuming that is mobility of a positive ion or an electron and E is a maximum value of an electric field, the ratio L/d of a maximum moving distance during a half-period L to the length of a gap d becomes $$L/d=2\mu E/2\pi fd$$

and the degree of the ratio shows the residual effect of the positive ions or the electrons. Then, $2\pi fd$ or fd can represent the influence of the frequency. Thus, when Paschen's law is extended up to a RF, a sparking voltage V can be represented by the following expression if the degree of vacuum is represented by p.

$$V=f(pd, fd)$$

When the frequency is very high, the electron temperature for the fixed electric field decreases due to inertia of the electron, and the ionization efficiency decreases. Therefore, the sparking voltage rises up.

Generally speaking about the frequency characteristic of the sparking voltage, if pd is very low, the decrease of $\gamma$ has a large effect owing to the residual effect of the positive ion, by which sometimes V becomes a value more than that in the case of DC. Even when the discharge does not take place in DC or a low frequency range for pd below $10^{-3}$ Torr.cm, the discharge takes place easily at a low voltage by secondary electron emission of the electrode when fd is over a critical value.

Further, according to the above-mentioned "Discharge Handbook" pp 237–245, in the microwave modulated by repetitive pulses (the repetitive frequency is fr and the pulse width is $\tau$) V is represented by the following expression.

$$V=f(pd, fr\cdot\tau)$$

If the frequency fr is small and the discharge is completed by one pulse, there is the following experiment expression in which V does not depend on fr so deeply, and is somewhat higher than that in a continuous wave like in the case of an impulse.

$$E/p=42\tau^{-1/B}fr^{-1/10}$$

where E is represented by the unit of V/cm, which is the peak value of the breakdown voltage, p is represented by the unit of Torr, $\tau$ is represented by the unit of $\mu$s, and fr is represented by the unit of kHz. The applicable range of this expression is as follows: that is, the wavelength $\lambda$ is within 1.25 to 10 cm, p is within 50 to 760 Torr, fr is within 0.02 to 2 kHz, $\tau$ is within 0.5 to 5 $\mu$s, the humidity is within 80 to 100%, the temperature is the room temperature, and pd $\lambda>50$.

Furthermore, a combination of these methods obtains the similar effect.

As described above, according to the first embodiment of this invention, since the RF electron gun which accelerates electrons generated from the cathode by the RF electric field is constituted in such a manner that if the electrons extracted by the positive electric field are made to enter the phase of the negative electric field by phase control of the microwave, the electrons are decelerated in its velocity and finally accelerated in the reverse direction to strike atoms of the cathode, thereby activating the cathode, the apparatus can be simplified, its effect of activation can be increased, and its operation can be simplified.

Further, according to the second embodiment of this invention, since the RF electron gun is constituted in such a manner that the laser light generated by the laser light generating device is made to strike the cathode, thereby activating the cathode, the apparatus can be simplified, its effect of activation can be increased, and its operation can be simplified.

Moreover, according to the third embodiment of this invention, since the RF electron gun is constituted in such a manner that the microwave generated by the microwave generating device is made to input into the RF cavity, thereby activating the surface of the cathode using discharge, the apparatus can be simplified, its effect of activation can be increased, and its operation can be simplified.

What is claimed is:

1. A RF gun which accelerates in a positive direction electrons generated from a cathode by a positive RF electric field generated by a microwave generating device in a RF cavity, comprising phase control means for said microwave generating device and means for controlling said phase control means for controlling the phase of said microwave electric field to cause said microwave generating device to generate a negative electric field for accelerating in the reverse direction the electrons generated from said cathode, wherein the reversely accelerated electrons are caused to strike said cathode, thereby activating said cathode.

2. In combination with a RF electron gun which accelerates electrons generated from a cathode using a RF electric field generated by a microwave generating device in a RF cavity, a laser light generating device added to the RF electron gun and means for causing the laser light generated by said laser light generating device to strike said cathode, thereby activating said cathode.

3. A RF electron gun which accelerates electrons generated from a cathode using a RF electric field generated by a microwave device in a RF cavity, comprising means for controlling and directing said RF electric field at said cathode to cause discharge of impurities from said cathode using the RF electric field generated by the microwave generating device in the RF cavity, thereby activating said cathode.

* * * * *

UNITED STATES PATENT AND TRADEMARK OFFICE

CERTIFICATE OF CORRECTION

PATENT NO. : 5,097,178

DATED : March 17, 1992

INVENTOR(S) : Susumu Nishihara

It is certified that error appears in the above-identified patent and that said Letters Patent is hereby corrected as shown below:

Column 2, line 7, "of" should be --for--;
line 10, delete "once".

Column 3, line 5, "wave" should be --waves--;
line 6, "microwave" should be --microwaves--;
line 14, after "them" insert --to--.

Column 4, line 21, "Ez·Eo sin$\theta$" should be --Ez = Eo · sin$\theta$--;
line 46, "great" should be --insufficient--;
lines 46-47, "sufficient" should be --great--.

Signed and Sealed this

Seventeenth Day of August, 1993

Bruce Lehman

*Attest:*

BRUCE LEHMAN

*Attesting Officer*

*Commissioner of Patents and Trademarks*